US007699437B2

(12) United States Patent
Choi et al.

(10) Patent No.: US 7,699,437 B2
(45) Date of Patent: Apr. 20, 2010

(54) ARRAY INKJET HEAD AND INKJET IMAGE-FORMING APPARATUS HAVING THE SAME

(75) Inventors: Sik-sun Choi, Osan-si (KR); Sung-ho Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 297 days.

(21) Appl. No.: 11/970,042

(22) Filed: Jan. 7, 2008

(65) Prior Publication Data

US 2009/0002442 A1 Jan. 1, 2009

(30) Foreign Application Priority Data

Jun. 27, 2007 (KR) ..... 10-2007-0063815

(51) Int. Cl.
*B41J 2/155* (2006.01)

(52) U.S. Cl. ..... 347/42; 347/49

(58) Field of Classification Search ..... 347/40, 347/42, 47, 49, 71
See application file for complete search history.

(56) References Cited

U.S. PATENT DOCUMENTS

2006/0170732 A1* 8/2006 Yamada ..... 347/49
2008/0055360 A1* 3/2008 Silverbrook et al. ..... 347/49

* cited by examiner

*Primary Examiner*—Thinh H Nguyen
(74) *Attorney, Agent, or Firm*—Stanzione & Kim, LLP

(57) ABSTRACT

An array inkjet head and an inkjet image forming apparatus having the array inkjet head. The array inkjet head is formed by sequentially combining a first member, a second member, a third member on an upper surface of which a plurality of base modules are mounted, and a cover member that covers the third member, and the cover member comprises a plurality of opening holes formed along the lengthwise direction of the cover member to expose the head chips and a plurality of concave units formed on both sides of each of the opening holes and to have a predetermined gaps between edge units of the base modules to be coated with an adhesive.

17 Claims, 6 Drawing Sheets

ARRAY INKJET HEAD AND INKJET IMAGE-FORMING APPARATUS HAVING THE SAME

CROSS-REFERENCE TO RELATED APPLICATIONS

This application claims the benefit under 35 U.S.C. §119 (a) from Korean Patent Application No. 10-2007-0063815, filed on Jun. 27, 2007, in the Korean Intellectual Property Office, the disclosure of which is incorporated herein in its entirety by reference.

BACKGROUND OF THE INVENTION

1. Field of the Invention

The present general inventive concept relates to an inkjet head usable with an inkjet image forming apparatus, and more particularly, to an inkjet image forming apparatus having an array inkjet head with an improved sealing structure.

2. Description of the Related Art

Conventionally, an inkjet image-forming apparatus forms an image on a piece of paper by ejecting ink from a printing head (a shuttle type printing head) that reciprocally travels, at a predetermined distance apart from an upper surface of the piece of paper, in a perpendicular direction (in a widthwise direction) to the moving direction of the piece of paper.

Recently, a high-speed inkjet image forming apparatus including an array inkjet head having a nozzle unit that has a length corresponding to the width of paper has been developed. In this case, since the array inkjet head is fixed and only the paper moves, the driving apparatus is simple, and thus, a high-speed printing can be realized.

FIG. 1 is an exploded perspective view illustrating an array inkjet head of a conventional inkjet image forming apparatus, and FIG. 2 is a front view illustrating a portion of the array inkjet head of FIG. 1.

Referring to FIGS. 1 and 2, the array inkjet head is assembled by sequentially coupling a first member 10, a second member 20, a third member 30, and a cover member 40. A plurality of base modules 31 is mounted on an upper surface of the third member 30 in a zigzag shape along the lengthwise direction of the array inkjet head. A head chip 32 is installed on an upper surface of each of the base modules 31. The head chips 32 are respectively connected to an electric wire unit 34. The base modules 31 are fixed on the third member 30 using a locking means such as screws 33.

The cover member 40 is combined with the upper part of the third member 30, and includes a plurality of opening holes 41 formed to expose the head chips 32 and a plurality of locking protrusions 42 formed on edges of the head chips 32 so that the cover member 40 can be fixed on the third member 30. A plurality of locking grooves 35 is formed on an edge of the third member 30 corresponding to the locking protrusions 42.

In the conventional array inkjet head, after the first member 10, the second member 20, and the third member 30 on which the base modules 31 are mounted are sequentially combined, the cover member 40 is combined with the third member 30. Thus, the head chips 32 are exposed through the opening holes 41, and gaps between the head chips 32 and the opening holes 41 are sealed by coating an adhesive 50 around the exposed head chips 32.

However, since the cover member 40 is fixed on the third member 30 using a plurality of locking protrusions 42, and the gaps between the cover member 40 and the third member 30 are sealed by coating the adhesive 50 around the head chips 32, the following problems occur.

First, the adhesive 50 is coated further higher than the head chips 32 since the adhesive 50 is coated around the head chips 32 after the cover member 40 is mounted on the third member 30. As a result, the wiping operation of the head chips 32 may be impossible since the adhesive 50 protrudes higher than the head chips 32.

Second, since the sealing is performed around the head chips 32 using the adhesive 50, the sealing may not be properly performed, thereby contaminating and damaging the head chip 32 and the array inkjet head. As a result, ink can penetrate into the third member 30, and thus, the electric wire unit 34 connected to the head chips 32 can be disconnected therefrom.

SUMMARY OF THE INVENTION

The present general inventive concept provides an array inkjet head that can prevent a printed circuit board from being disconnected by preventing the penetration of ink around head chips by sealing areas around the head chips, and an inkjet image forming apparatus having the array inkjet head.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an array inkjet head that is formed by sequentially combining a first member, a second member, a third member on an upper surface on which a plurality of base modules are mounted, and a cover member that covers the third member, wherein the cover member comprises a plurality of opening holes formed along the lengthwise direction of the cover member to expose the head chips and a plurality of concave units are formed on both sides of each of the opening holes and have a predetermined gaps between edge units of the base modules to be coated with an adhesive.

The foregoing and/or other aspects and utilities of the present general inventive concept may be achieved by providing an array inkjet head including one or more base modules each having one or more head chips, and a cover member disposed to cover the base module, and having a plurality of opening holes formed on a major surface to expose the head chips, and a concave unit recessed from the major surface to cover the head chips and the base modules.

The array inkjet head may further include a unit having a plurality of members each having a plurality of ink paths to direct the ink in a plurality of directions to supply the ink to the head chips, and the base module may be disposed on the unit to connect the ink paths of the unit to the head chips, and the concave unit covers a side of the head chips and a base surface of the base modules.

The array inkjet head may further include a unit having a first member having a first number of ink paths to receive ink, and a second member having a second number of ink paths to direct the ink received from the first member toward corresponding ones of the head chips, and the head chips may protrude from a base surface of the one or more base modules by a first distance, and the concave unit is recessed from the major surface by a second distance.

The head chips may protrude from a base surface of the one or more base modules, and the concave unit may include a first portion to correspond to the major surface and a second portion to correspond to the base surface.

The major surface of the cover member may be disposed on a same plane as a top surface of the head chips, and the concave unit may include a first portion inclined from the major surface and a second portion spaced apart from the major surface by a distance.

The concave unit may be disposed between the adjacent openings.

The base modules may include edge units disposed on the adjacent base modules, and the concave unit may cover the edge units of the base modules.

The base modules may include edge units spaced apart from each other to form a gap, the concave unit may cover the gap of the edge units of the base modules, and the gap may be filled with an adhesive.

The array inkjet head may further include a wire unit connected to a corresponding one of the head chips, the concave unit may cover the wire unit and is spaced apart from the wire to form a gap, and the gap may be filled with an adhesive.

The cover member may include a groove unit to define the opening, and an adhesive may be filled between the groove unit and the corresponding head chip.

The major surface may be spaced-apart from the base modules by a first distance, and the concave unit may be spaced-apart from the base modules by a second distance shorter than the first distance.

The foregoing and/or other aspects and utilities of the present general inventive concept may be achieved by providing an image forming apparatus including a transport unit to feed a printing medium, an ink cartridge having an ink tank and an array inkjet head to receive ink from the ink tank and to eject the ink to the printing medium to form an image on the printing medium, the array inkjet head having one or more base modules each having one or more head chips, and a cover member disposed to cover the base module, and comprising a plurality of opening holes formed on a major surface to expose the head chips, and a concave unit recessed from the major surface to cover the head chips and the base modules.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
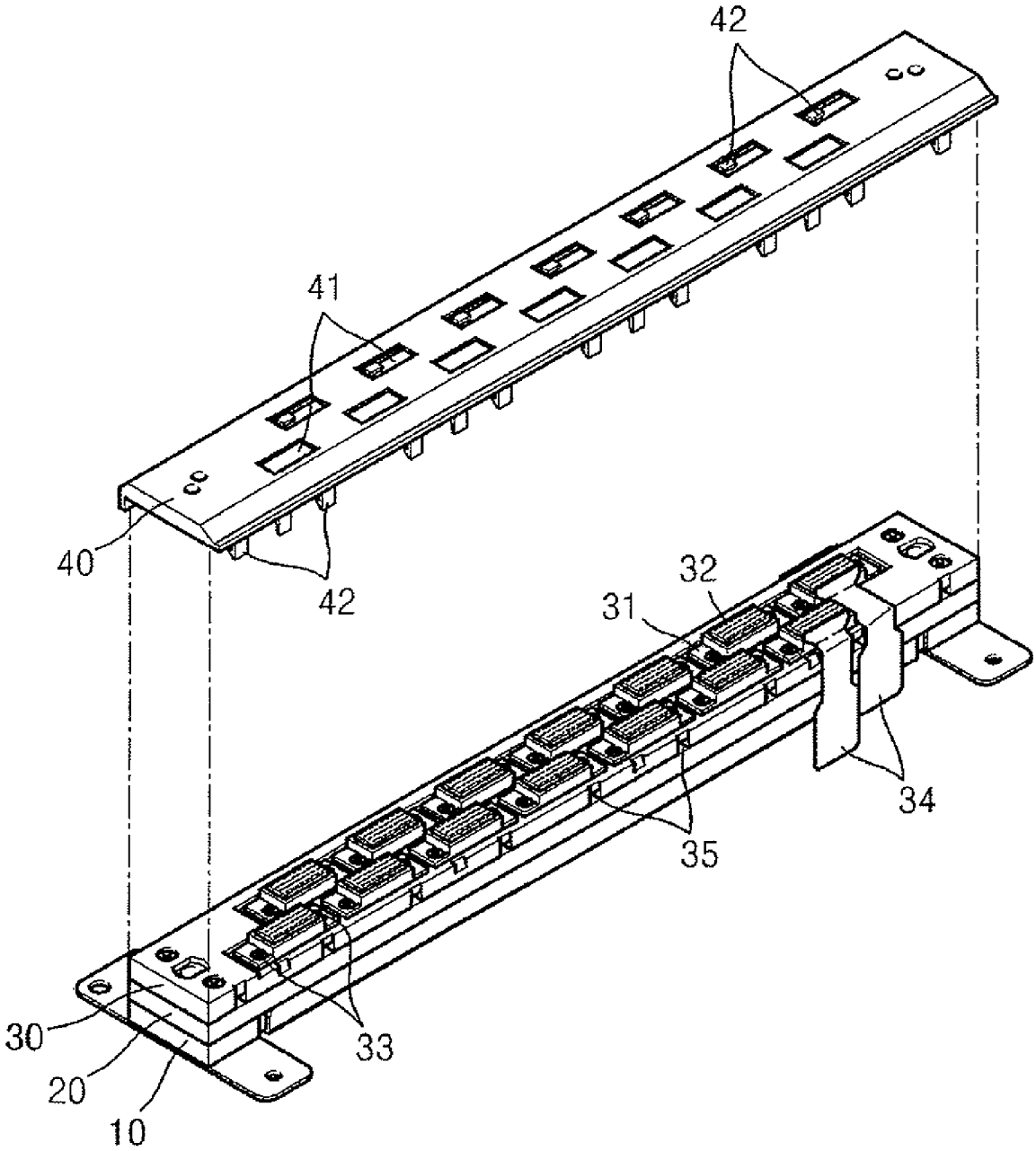
FIG. 1 is an exploded perspective view illustrating an array inkjet head of a conventional inkjet image forming apparatus.
Figure 2:
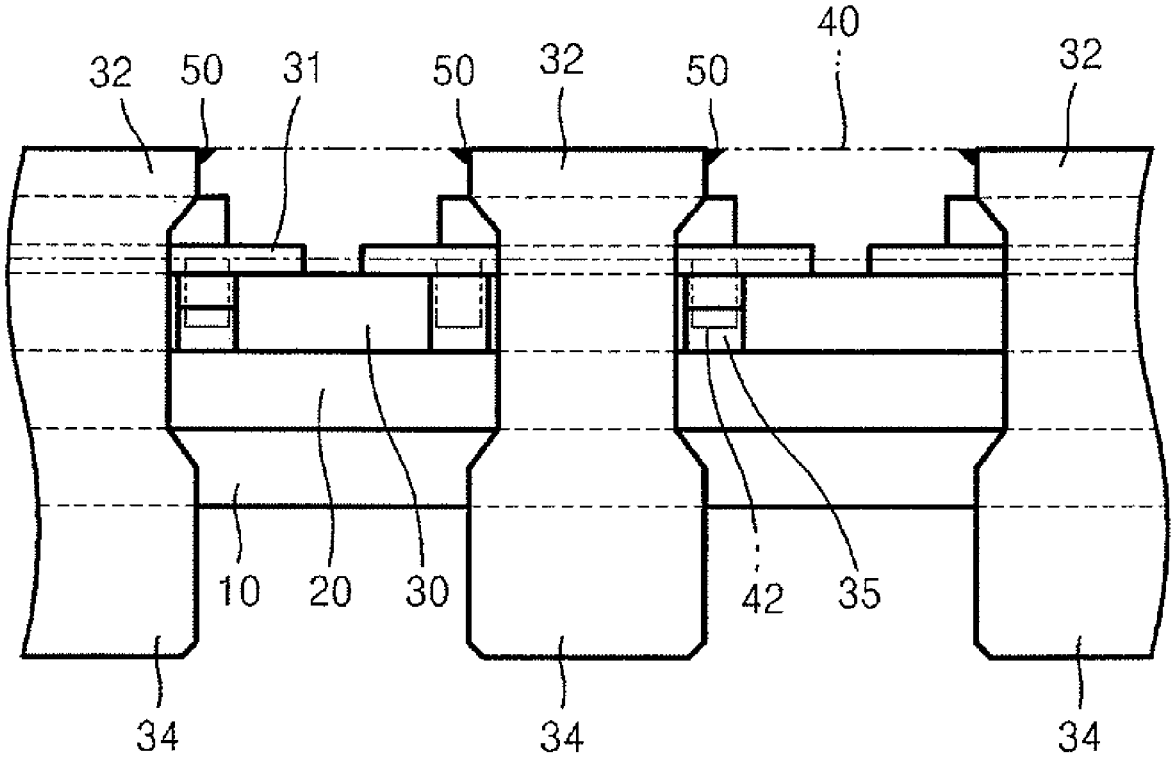
FIG. 2 is a front view illustrating a portion of the array inkjet head of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
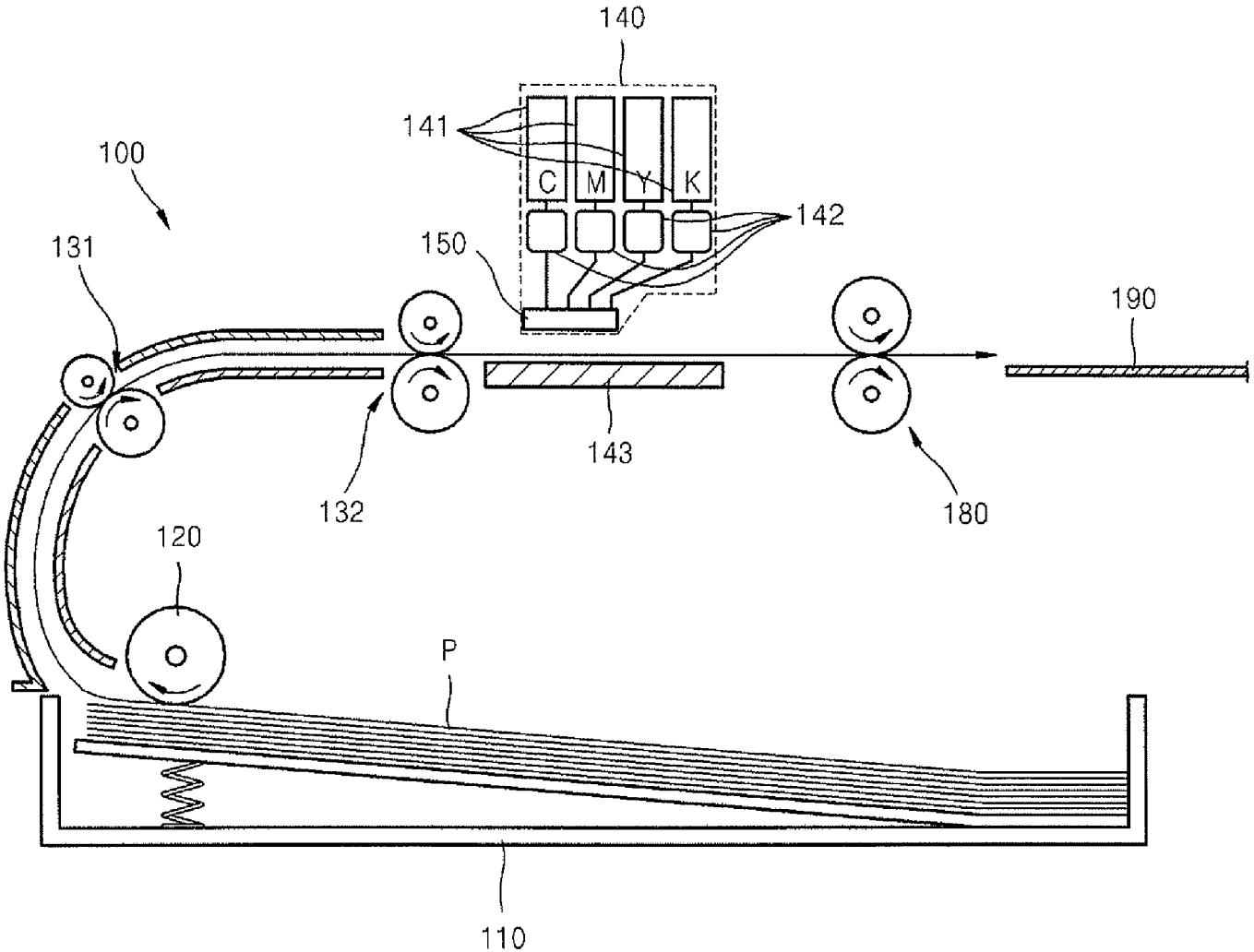
FIG. 3 is a schematic view illustrating an inkjet image forming apparatus having an array inkjet head according to an embodiment of the present general inventive concept.
Figure 4:
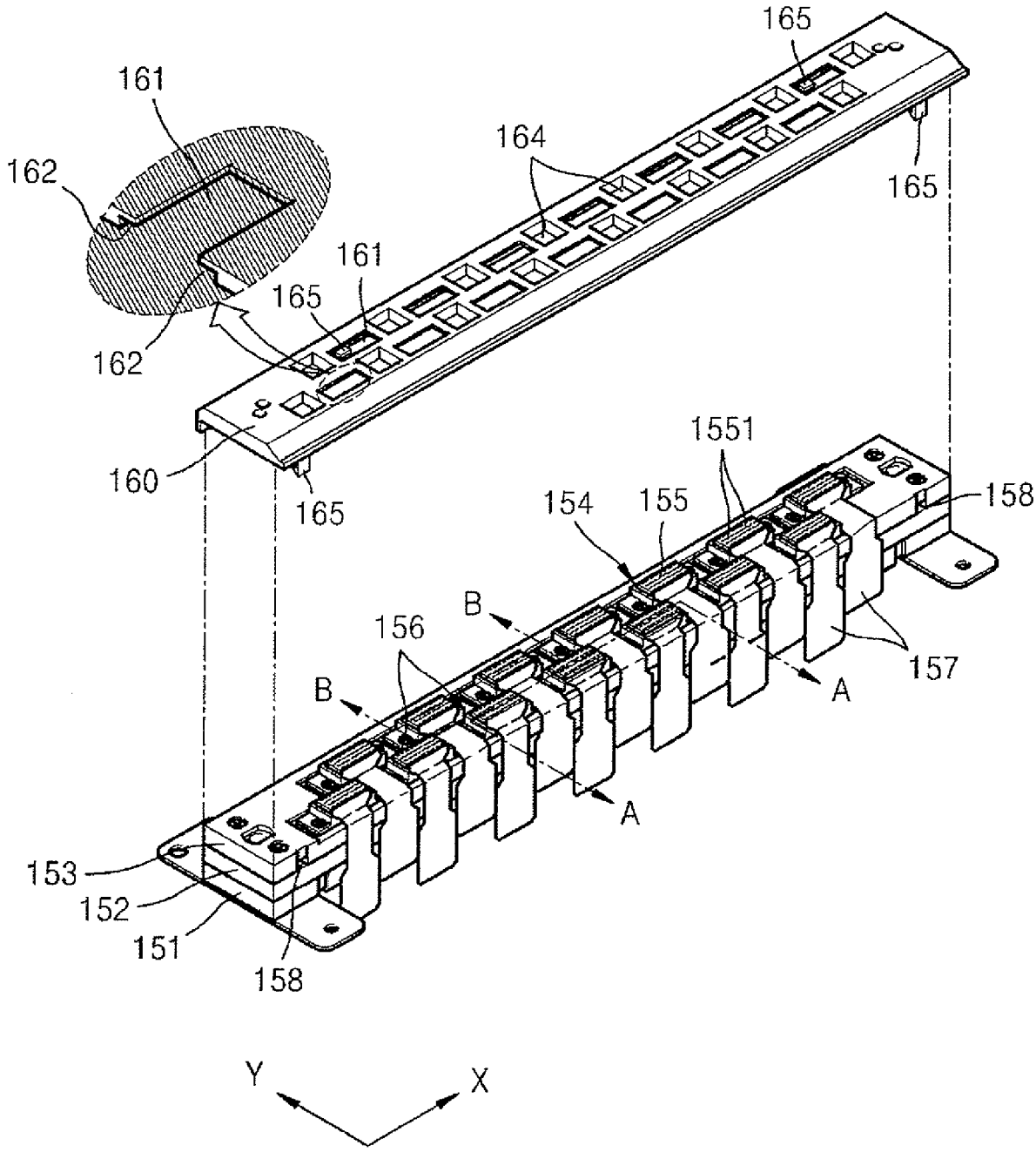
FIG. 4 is an exploded perspective view illustrating the array inkjet head of FIG. 3 according to an embodiment of the present general inventive concept.
Figure 5:
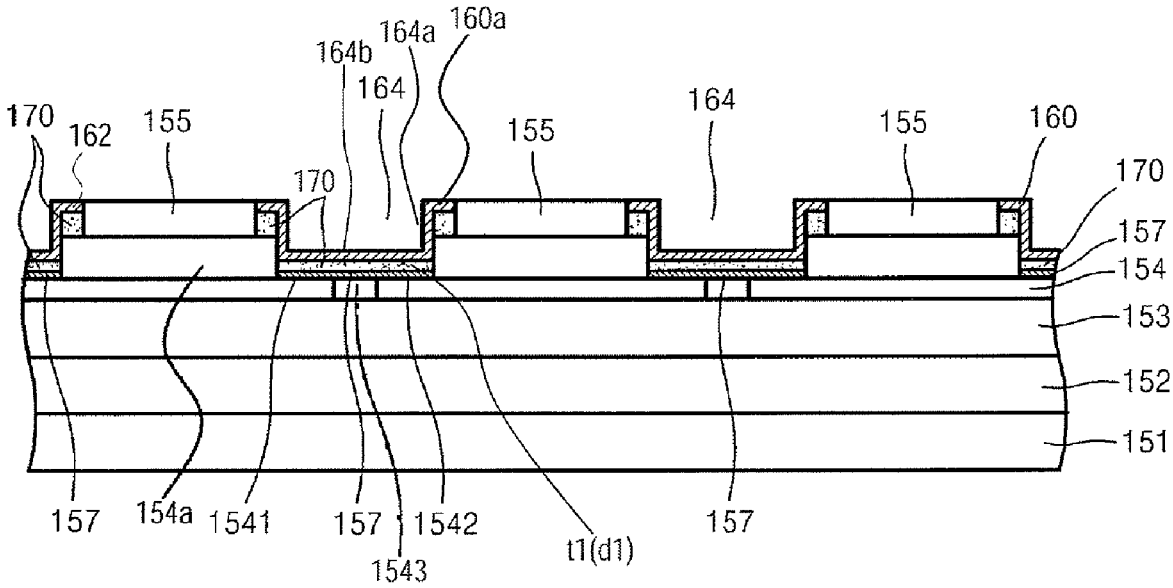
FIG. 5 is a cross-sectional view taken along line A-A of FIG. 4, according to an embodiment of the present general inventive concept.
Figure 6:
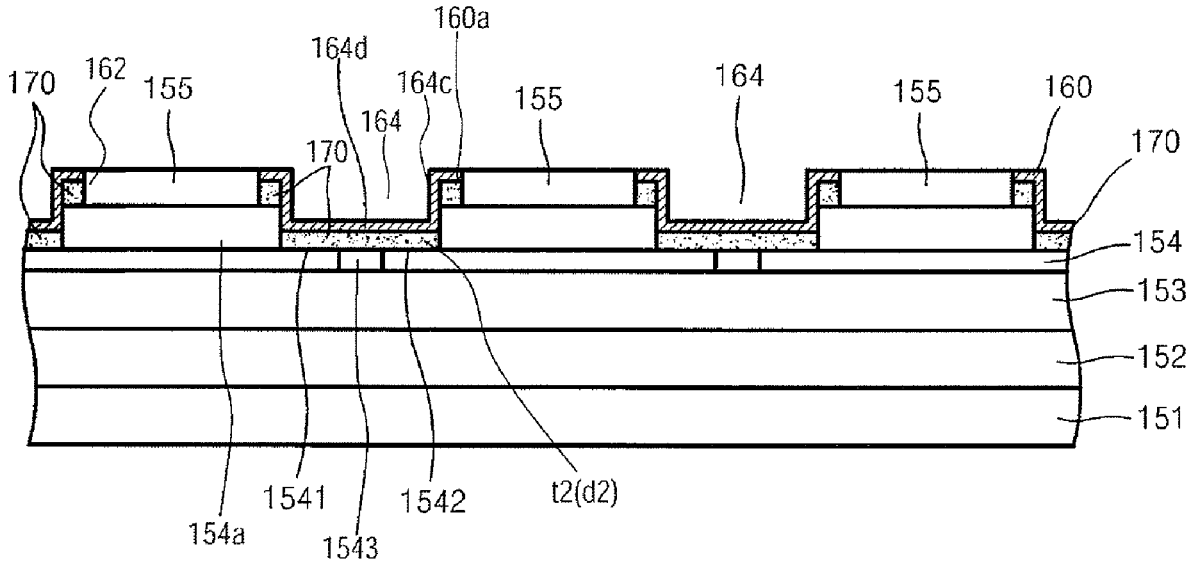
FIG. 6 is a cross-sectional view taken along line B-B of FIG. 4, according to an embodiment of the present general inventive concept.

FIG. 3 is a schematic drawing illustrating an inkjet image forming apparatus 100 having an array inkjet head according to an embodiment of the present general inventive concept. FIG. 4 is an exploded perspective view illustrating the array inkjet head of FIG. 3 according to an embodiment of the present general inventive concept. FIG. 5 is a cross-sectional view taken along line A-A of FIG. 4, and FIG. 6 is a cross-sectional view taken along line B-B of FIG. 4, according to an embodiment of the present general inventive concept.

Referring to FIG. 3, the inkjet image forming apparatus 100 includes a cassette 110, an ink cartridge 140, and a discharge roller unit 180.

The cassette 110 contains a printing media, such as a plurality of sheets of paper P, and a pick-up roller 120 that picks up each sheet of paper P is installed above the cassette 110. The paper P, which is picked up by the pick-up roller 120, moves along a printing path indicated by an arrow, and an image is printed onto the paper P. A first transport roller unit 131, a second transport roller unit 132, an array inkjet head 150, the discharge roller unit 180, and a discharged paper tray 190 are sequentially disposed on the printing path. The second transport roller unit 132 is installed close to the array inkjet head 150, includes a pair of rollers facing each other, and has a registration function for arranging the papers P.

The ink cartridge 140 has a length corresponding to a width of the paper P perpendicular to the printing path, and includes the array inkjet head 150 that includes a plurality of nozzles to eject ink, four ink tanks 141 (141C, 141M, 141Y, and 141K) that respectively contain cyan C, magenta M, yellow Y, and black K color ink, and four negative pressure controllers 142 (142C, 142M, 142Y, and 142K) that prevent air from entering into the array inkjet head 150 and also prevent inks from leaking therefrom by maintaining an ink meniscus by controlling a negative pressure of the ink entering into the array inkjet head 150.

A platen 143 that supports the paper P that passes under the array inkjet head 150 is installed below the ink cartridge 140. The paper P that passes under the array inkjet head 150 is maintained at a uniform distance from the array inkjet head 150 by the platen 143.

The image is printed on the paper P by ink ejected from the array inkjet head 150 when the paper P passes under the array inkjet head 150. The array inkjet head 150 may be fixed with respect to the printing path.

The discharge roller unit 180 discharges paper P on which an image is printed, and the paper P discharged by the discharge roller unit 180 is stacked in the discharged paper tray 190.

Referring to FIGS. 4 and 5, the array inkjet head 150 is formed by combining a first member 151, a second member 152, a third member 153, and a cover member 160.

A plurality of base modules 154 is disposed on an upper surface of the third member 153 in a zigzag shape along a lengthwise direction of the third member 153.

The base modules 154 are fixed on the third member 30 using a fixing units such as screws 156. A plurality of head chips 155 on which a plurality of nozzles 1551 are formed are mounted on an upper surface (base surface) of the base modules 154. The head chips 155 are respectively connected to electric wire units 157. Ink ejection through the nozzles 1551 of the head chips 155 is controlled via a voltage received through the electric wire units 157 in accordance to an image to be printed. The voltage is applied to a driving unit (not illustrated) of the head chip 155 to generate a force to eject ink through the corresponding nozzle The first member 151, the second member 152, and the third member 153 each include one or more ink paths in one or more directions therein to direct the ink in desired directions to corresponding nozzles and corresponding ink chambers of the head chip from ink tank 141 and the negative pressure containers 142. For example, the first member 151 is connected to the respective negative pressure containers 142 to receive the inks from the ink tank 141, and the ink paths formed in the first, second, and third members 151, 152, and 153 direct the inks in respective directions to supply the inks to the corresponding head chips 155, such that the nozzles of the head chip 155 can eject the different inks. A conventional combination of first, second, and third members may be used as the combination of the first, second, and third members 151, 152, and 153.

The cover member 160 is combined with the upper part of the third member 153, and includes a plurality of opening holes 161 formed corresponding to the head chips 155 to expose the head chips 155 from a major surface 160*a* of the cover member 160 toward the platen 143. The major surface 160*a* of the cover member 160 faces the paper P supported by the platen 143.

Concave units 164 are formed on both sides of the opening holes 161 of the cover member 160 along the lengthwise direction (an X direction) of the array inkjet head 150. The concave units 164 are formed between the opening holes 161. As illustrated in FIG. 5, the concave units 164 are separated by a predetermined distance from upper surfaces of edge units 1541 and 1542 of both sides of the base modules 154 to form a predetermined space, and an adhesive 170 may be coated in the predetermined space. Groove units 162 where the adhesive 170 can be coated are formed to surround the opening hole 161 around each of the opening holes 161.

As illustrated in FIG. 4, the electric wire units 157 respectively connected to the head chips 155 are arranged to face a side of the third member 153. Thus, when the cover member 160 is inserted into the third member 153, the electric wire units 157 are located immediately below the concave units 164, and as illustrated in FIG. 5, the adhesive 170 is coated or applied between the lower surfaces of the concave units 164 and the electric wire units 157. However, as illustrated in FIG. 6, since both edge units 1541 and 1542 of the base module 154 are located below the concave unit 164 on the other side of the third member 153 where the electric wire units 157 are not arranged, the adhesive 170 is coated between the lower surface of the concave unit 164 and both the edge units 1541 and 1542 the edge units 1541 and 1542 are spaced by a portion 1543 n the base member 154.

The arrangement of the electric wire units 157 is not limited to the arrangement shown in FIG. 4, and the electric wire units 157 can be arranged to face both sides of the third member 153 by dividing the electric wire units 157.

Referring to FIGS. 5 and 6, the concave unit 164 includes first portions 164*a* and 164*c* inclined from the major surface 160*a* of the cover member 160, and second portions 164*b* and 164*d* extended from the corresponding first portions 164*a* and 164*c* to be recessed from the major surface 160*a* of the cover member 160 by a distance. An upper surface portion of the head chip 155 may be disposed on the same plane of the major surface 160*a*. The first portions 164*a* and 164*c* may be inclined from the major surface 160*a* by a right angle to face a side surface of the head chip 155, and the second portions 164*b* and 164*d* may be disposed to face the base module 151 and/or the wire 157.

The adhesive 170 is filled in a first gap between the head chip 155 and the first portions 164*a* and 164*c* of the concave unit 164 and a second gap between the second portions 164*b* and 164*d* of the concave unit 164 and the base module 151 and/or the wire unit 157. The adhesive 170 in the first gap may be between the groove unit 162 and a side of the head chip 155. The head chip may include a second side to face and/or contact the first portions 164*a* and 164*c*. The adhesive 170 in the second gap may vary according to a location of the concave unit 164 with respect to the base module 154, the head chip 155, and/or the openings of the cover member 160. That is, the adhesive 170 in the second gap may have a thickness t1 or a distance d1 between the second portions 164*b* and 164*d* and the wire unit 157, and may have a thickness t2 or a distance d2 between the second portions 164*b* and 164*d* of the concave unit 164 and the base module 151.

A plurality of locking protrusions 165 are formed on each side of the cover member 160 in a lengthwise direction (an X direction) of the cover member 160. A plurality of locking groove hole units 158 are formed on the third member 153 corresponding to the locking protrusions 165 of the cover member 160 so that the locking protrusions 165 respectively can be inserted.

As described above, the cover member 160 is attached to the third member 153 via the adhesive 170 that is coated in the groove unit 162 and both the edge units 1541 and 1542 of the base module 154. That is, the area of coating the adhesive 170 is increased, thereby sufficiently fixing the cover member 160 to the third member 153 although the number of locking protrusions 165 is reduced compared to a conventional array inkjet head.

A method of assembling of the array inkjet head 150 having the above configuration according to an embodiment of the present invention will now be described.

Referring to FIG. 4, the first member 151, the second member 152, and the third member 153 on which the base modules 154 are mounted are sequentially combined from the lower side. Next, after coating the groove units 162 of the cover member 160 and the lower surfaces of the concave units 164 with the adhesive 170, the cover member 160 is inserted into the third member 153 and the locking protrusions 165 are inserted into the locking groove hole units 158. Thus, the locking protrusions 165 are fixed in the locking groove hole units 158 and the adhesive 170 attaches the cover member 160 to the third member 153. Meanwhile, after coating the adhesive 170 around the head chips 155 and the edges 1541 and 1542 of the base modules 154, the cover member 160 may be fixed thereon.

In particular, since the gaps between the perimeter of the head chips 155 and the cover member 160 are sealed using the adhesive 170 coated in the groove units 162, the absorption of ink into the third member 153 through the opening holes 161 can be prevented.

As described above, the array inkjet head of the present invention has the following advantages.

First, since the process of coating the adhesive is completed prior to fixing the cover member on the third member by covering the third member, it is unnecessary to additionally seal the sides of the array head chips, thereby simplifying the manufacturing process.

Second, the electric wire units are fixed between the cover member and the third member by coating the adhesive on the electric wire units, and thus, the electric wire units are not in contact with ink, thereby preventing the electric wire units from being disconnected.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An array inkjet head comprising:

a unit formed by sequentially combining a first member, a second member, a third member;

a plurality of base modules disposed on the unit, and each having one or more head chips; and a cover member disposed to cover the unit, and comprising:

a plurality of opening holes formed along a lengthwise direction of the cover member to expose the head chips, and a plurality of concave units formed on both sides of each of the opening holes to have gaps between edge units of the base modules to be coated with an adhesive.

2. The array inkjet head of claim 1, further comprising:

groove units which are formed to surround edges of the opening holes and where an adhesive is coated, and to seal gaps between the head chips and the opening holes.

3. The array inkjet head of claim 1, wherein:

the head chips are connected to electric wire units; and the electric wire units are fixed on a lower part of the concave units using an adhesive.

4. The array inkjet head of claim 1, wherein:

the opening holes are disposed in a zigzag shape along the lengthwise direction of the opening holes; and the concave units are also disposed in a zigzag shape corresponding to the zigzag shape of the opening holes.

5. An inkjet image forming apparatus comprising:

an array inkjet head having a length corresponding to a width of a printing medium and a plurality of ink tanks that contain a plurality of inks and supply the inks to the array inkjet head, wherein the array inkjet head comprises:

a unit formed by sequentially combining a first member, a second member, a third member;

a plurality of base modules disposed on the unit, and having one or more head chips; and a cover member disposed to cover the unit, and comprising:

a plurality of opening holes formed along a lengthwise direction of the cover member to expose the head chips, and a plurality of concave units formed on both sides of each of the opening holes to have gaps between edge units of the base modules to be coated with an adhesive.

6. The inkjet image forming apparatus of claim 5, further comprising:

groove units which are formed to surround edges of the opening holes and where an adhesive is coated, and to seal gaps between the head chips and the opening holes.

7. The inkjet image forming apparatus of claim 5, wherein:

the head chips are connected to electric wire units; and the electric wire units are fixed on a lower part of the concave units using an adhesive.

8. The inkjet image forming apparatus of claim 5, wherein:

the opening holes are disposed in a zigzag shape along the lengthwise direction of the opening holes; and the concave units are also disposed in a zigzag shape corresponding to the zigzag shape of the opening holes.

9. An array inkjet head comprising:

one or more base modules each having one or more head chips; and a cover member disposed to cover the base module, and comprising:

a plurality of opening holes formed on a major surface to expose the head chips, and a concave unit recessed from the major surface to cover the head chips and the base modules.

10. The array inkjet head of claim 9, further comprising:

a unit having a plurality of members each having a plurality of ink paths to direct the ink in a plurality of directions to supply the ink to the head chips, wherein the base module is disposed on the unit to connect the ink paths of the unit to the head chips, and the concave unit covers a side of the head chips and a base surface of the base modules.

11. The array inkjet head of claim 9, further comprising:

a unit having a first member having a first number of ink paths to receive ink, and a second member having a second number of ink paths to direct the ink received from the first member toward corresponding ones of the head chips, wherein the head chips protrude from a base surface of the one or more base modules by a first distance, and the concave unit is recessed from the major surface by a second distance.

12. The array inkjet head of claim 9, wherein the head chips protrude from a base surface of the one or more base modules, and the concave unit comprises a first portion to correspond to the major surface and a second portion to correspond to the base surface.

13. The array inkjet head of claim 9, wherein the concave unit is disposed between the adjacent openings.

14. The array inkjet head of claim 9, wherein the base modules comprises edge units disposed on the adjacent base modules, and the concave unit covers the edge units of the base modules.

15. The array inkjet head of claim 9, wherein the base modules comprises edge units spaced apart from each other to form a gap, and the concave unit covers the gap of the edge units of the base modules, and the gap is filled with an adhesive.

16. The array inkjet head of claim 9, wherein the cover member comprises a groove unit to define each opening, and an adhesive is filled between the groove unit and the corresponding head chip.

17. An image forming apparatus comprising:

a transport unit to feed a printing medium;

an ink cartridge having an ink tank and an array inkjet head to receive ink from the ink tank and to eject the ink to the printing medium to form an image on the printing medium, the array inkjet head comprising:

one or more base modules each having one or more head chips; and a cover member disposed to cover the base module, and comprising a plurality of opening holes formed on a major surface to expose the head chips, and a concave unit recessed from the major surface to cover the head chips and the base modules.

* * * * *